US009002251B2

(12) United States Patent
Hasegawa et al.

(10) Patent No.: US 9,002,251 B2
(45) Date of Patent: Apr. 7, 2015

(54) FIXING DEVICE AND IMAGE FORMING APPARATUS INCORPORATING SAME

(71) Applicants: Motokazu Hasegawa, Kanagawa (JP); Susumu Matsusaka, Kanagawa (JP); Yukari Isoe, Kanagawa (JP)

(72) Inventors: Motokazu Hasegawa, Kanagawa (JP); Susumu Matsusaka, Kanagawa (JP); Yukari Isoe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/182,878

(22) Filed: Feb. 18, 2014

(65) Prior Publication Data

US 2014/0241764 A1 Aug. 28, 2014

(30) Foreign Application Priority Data

Feb. 26, 2013 (JP) ..... 2013-035610

(51) Int. Cl.
*G03G 15/20* (2006.01)

(52) U.S. Cl.
CPC .... *G03G 15/2053* (2013.01); *G03G 2215/2032* (2013.01)

(58) Field of Classification Search
CPC ..... G03G 15/2017; G03G 15/2053; G03G 2215/2016
USPC ..... 399/328, 329
See application file for complete search history.

(56) References Cited

U.S. PATENT DOCUMENTS 6,646,239 B2 * 11/2003 Takagi et al. ..... 219/619
2009/0101635 A1 * 4/2009 Yokoyama et al. ..... 219/619
2012/0177418 A1 7/2012 Hashiyada et al.
2012/0177419 A1 * 7/2012 Kikuchi ..... 399/329
2014/0205331 A1 7/2014 Kobashigawa et al.
2014/0205333 A1 7/2014 Hasegawa et al.
2014/0219694 A1 8/2014 Matsusaka et al.
2014/0233994 A1 8/2014 Isoe et al.

FOREIGN PATENT DOCUMENTS

JP 2009-288396 12/2009
JP 2009-288578 12/2009
JP 2012-159829 8/2012
JP 2013-127645 6/2013

OTHER PUBLICATIONS

U.S. Appl. No. 14/152,057, filed Jan. 10, 2014.
U.S. Appl. No. 14/156,628, filed Jan. 16, 2014.
U.S. Appl. No. 14/161,337, filed Jan. 22, 2014.
U.S. Appl. No. 14/168,179, filed Jan. 30, 2014.

* cited by examiner

*Primary Examiner* — Gregory H Curran
(74) *Attorney, Agent, or Firm* — Oblon, McClelland, Maier & Neustadt, L.L.P.

(57) ABSTRACT

A fixing device includes a fixing member including a heat generator and an induction heater to heat the fixing member by electromagnetic induction. The induction heater includes an excitation coil, a ferromagnetic core to form a magnetic path to direct magnetic flux arising from the excitation coil to the fixing member, and a holder to hold the excitation coil and the ferromagnetic core. The holder has a surface facing the heat generator. The surface has a plurality of slits extending parallel to a direction of rotation of the fixing member. The ferromagnetic core is coupled to the holder and covers an open bottom portion of each slit of the plurality of slits to form a plurality of bottomed grooves.

5 Claims, 8 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2013-035610, filed on Feb. 26, 2013, in the Japan Patent Office, the entire disclosure of which is hereby incorporated by reference herein.

BACKGROUND

1. Technical Field

Embodiments of this disclosure generally relate to a fixing device to fix an unfixed toner image onto a recording medium by electromagnetic induction heating, and to an electrophotographic image forming apparatus, such as a copier, a printer, a facsimile machine, or a multifunction machine having two or more of copying, printing, and facsimile capabilities, incorporating the fixing device.

2. Related Art

Image forming apparatuses may incorporate a fixing device employing an electromagnetic induction heating method to reduce startup time of the image forming apparatuses, thereby enhancing energy efficiency. Such a fixing device employing the electromagnetic induction heating method includes, e.g., a heating roller serving as a heat generator, a fixing roller, an endless fixing belt stretched over the heating roller and the fixing roller, an induction heater facing the heating roller via the fixing belt, and a pressing roller to contact the fixing roller via the fixing belt. The induction heater includes, e.g., an excitation coil wound in a longitudinal direction of the induction heater, cores to direct alternating magnetic flux arising from the excitation coil to the heat generator, and a holder (or coil guide) to hold the excitation coil and the cores.

The induction heater faces and heats the fixing belt. The heated fixing belt heats and fixes a toner image formed on a recording medium conveyed between the fixing roller and the pressing roller. Specifically, a high-frequency alternating current supplied to the excitation coil forms an alternating magnetic field around the excitation coil, which generates eddy currents on a surface of the heating roller. When the eddy currents are generated around the heating roller serving as a heat generator, the electrical resistance of the heating roller leads to Joule heating of the heating roller, thereby heating the fixing belt stretched over the heating roller.

In such a fixing device employing the electromagnetic induction heating method, the heat generator is directly heated by electromagnetic induction. Accordingly, compared to a typical fixing device using a halogen heater, the fixing device employing the electromagnetic induction heating method has a higher heat-exchange efficiency and therefore the surface temperature of the fixing belt can be increased to a desired fixing temperature more efficiently, that is, with less energy and a shorter startup time.

Toner includes wax to enhance fixing performance at a low temperature, and to facilitate separation of recording media from a fixing member (fixing belt or fixing roller) and a pressing member (pressing roller or pressing belt). When such toner including wax is used for a fixing operation employing the induction heating method, the wax may cause fixing failures, e.g., the wax may adhere to a recording medium during fixing of an image formed on the recording medium. Specifically, the wax is evaporated when the toner is heated in the fixing nip. The evaporated wax floats and moves by rotation of the fixing member, and consequently adheres to the holder (or coil guide) of the induction heater that is disposed facing the fixing member, particularly to a surface that faces the fixing member. As the wax adhering to the holder accumulates, it eventually fills a small gap between the induction heater and the fixing member, and some of the wax adheres to the fixing member. The wax adhering to the fixing member is fused again and adheres to the recording medium in the fixing nip, thereby causing a fixing failure in that the wax adheres to the recording medium during fixing of the image formed on the recording medium.

As one approach to such fixing failure, JP-2009-288578-A provides a passage for drainage on a surface of an induction heater facing the fixing member to drain off any wax adhering to the surface. Yet the wax may still accumulate without being drained, depending on how the induction heater is oriented. Moreover, the drainage passage is provided in a holder (or coil guide) made of resin, and because the resin has good heat resistance, the accumulated wax is easily fused again upon absorbing heat from the fixing member. Consequently, the wax adheres to a recording medium during fixing of an image formed on the recording medium.

SUMMARY

This specification describes below an improved fixing device. In one embodiment of this disclosure, the fixing device includes a fixing member including a heat generator and an induction heater to heat the fixing member by electromagnetic induction. The induction heater includes an excitation coil, a ferromagnetic core to form a magnetic path to direct magnetic flux arising from the excitation coil to the fixing member, and a holder to hold the excitation coil and the ferromagnetic core. The holder has a surface facing the heat generator. The surface has a plurality of slits extending parallel to a direction of rotation of the fixing member. The ferromagnetic core is coupled to the holder and covers an open bottom portion of each slit of the plurality of slits to form a plurality of bottomed grooves.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
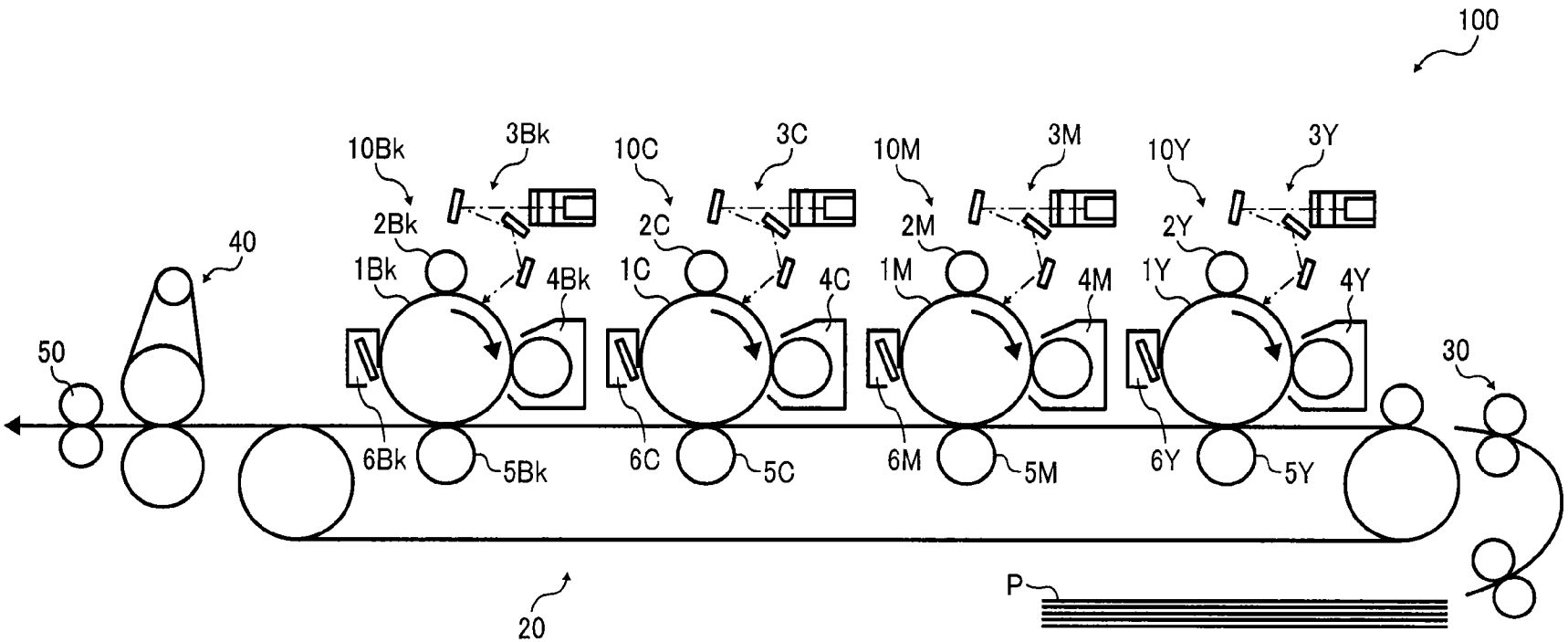
FIG. 1 is a schematic view of an image forming apparatus according to embodiments of this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals will be given to identical or corresponding constituent elements such as parts and materials having the same functions, and redundant descriptions thereof will be omitted unless otherwise required.

Referring now to the drawings, wherein like reference numerals designate identical or corresponding parts throughout the several views, embodiments of this disclosure are described below.

Initially with reference to FIG. 1, a description is given of an entire configuration and operation of an image forming apparatus 100 according to embodiments of this disclosure. It is to be noted that, in the following description, suffixes Y, M, C, and Bk denote colors yellow, magenta, cyan, and black, respectively.

FIG. 1 is a schematic view of the image forming apparatus 100 according to the embodiments of this disclosure.

The image forming apparatus 100, herein serving as a printer, includes four imaging stations 10Y, 10M, 10C, and 10Bk. The imaging stations 10Y, 10M, 10C, and 10Bk include photoconductive drums 1Y, 1M, 1C, and 1Bk, and form toner images of yellow, magenta, cyan, and black on surfaces of the photoconductive drums 1Y, 1M, 1C, and 1Bk, respectively. A conveyance belt 20 is disposed below the imaging stations 10Y, 10M, 10C, and 10Bk to convey a sheet P serving as a recording medium through the imaging stations 10Y, 10M, 10C and 10Bk.

The photoconductive drums 1Y, 1M, 1C, and 1Bk of the respective imaging stations 10Y, 10M, 10C and 10Bk are disposed to rotatably contact the conveyance belt 20. The sheet P electrostatically adheres to a surface of the conveyance belt 20. It is to be noted that the four imaging stations 10Y, 10M, 10C, and 10Bk have the same configurations, differing only in the color of toner employed. Hence, a description is herein given only of the imaging station 10Y employing the yellow color, which is disposed at a most upstream end in a direction in which the sheet P is conveyed, as a representative example of the imaging stations 10M, 10C, and 10Bk. Detailed descriptions of the imaging stations 10M, 10C and 10Bk are herein omitted, unless otherwise required.

The imaging station 10Y includes the photoconductive drum 1Y disposed substantially at a center of the imaging station 10Y. The photoconductive drum 1Y rotatably contacts the conveyance belt 20. The photoconductive drum 1Y is surrounded by various pieces of imaging equipment, such as a charging device 2Y, an exposure device 3Y, a developing device 4Y, a transfer roller 5Y, a drum cleaner 6Y, and a charge neutralizing device, disposed sequentially along a direction of rotation of the photoconductive drum 1Y. The charging device 2Y charges the surface of the photoconductive drum 1Y so that a predetermined electric potential is created on the surface of the photoconductive drum 1Y. The exposure device 3Y directs light to the charged surface of the photoconductive drum 1Y according to an image signal after color separation to form an electrostatic latent image on the surface of the photoconductive drum 1Y. The developing device 4Y develops the electrostatic latent image thus formed on the surface of the photoconductive drum 1Y with toner of yellow, thereby forming a visible image, also known as a toner image, in this case of the color yellow. The transfer roller 5Y serving as a transfer device transfers the toner image thus developed onto the sheet P conveyed by the conveyance belt 20. The drum cleaner 6Y removes residual toner remaining on the surface of the photoconductive drum 1Y after a transfer process. The charge neutralizing device removes residual charge from the surface of the photoconductive drum 1Y.

A sheet-feeding unit 30 is disposed to the right of the conveyance belt 20, at a bottom right in FIG. 1, to feed the sheet P onto the conveyance belt 20. In addition, a fixing device 40 is disposed to the left of the conveyance belt 20 in FIG. 1. The sheet P conveyed by the conveyance belt 20 is then continuously conveyed to the fixing device 40 through a conveyance path, which extends from the conveyance belt 20 through the fixing device 40. The fixing device 40 applies heat and pressure to the sheet P thus conveyed, on a surface of which the toner images of yellow, magenta, cyan, and black are transferred. Thus, the fixing device 40 fuses the toner images of yellow, magenta, cyan, and black so that the toner images of yellow, magenta, cyan, and black permeate the sheet P, thereby fixing the toner images of yellow, magenta, cyan, and black onto the sheet P. The sheet P thus passes through the fixing device 40 and is then discharged by a pair of discharging rollers 50 disposed downstream from the fixing device 40 on the conveyance path.

Figure 2:
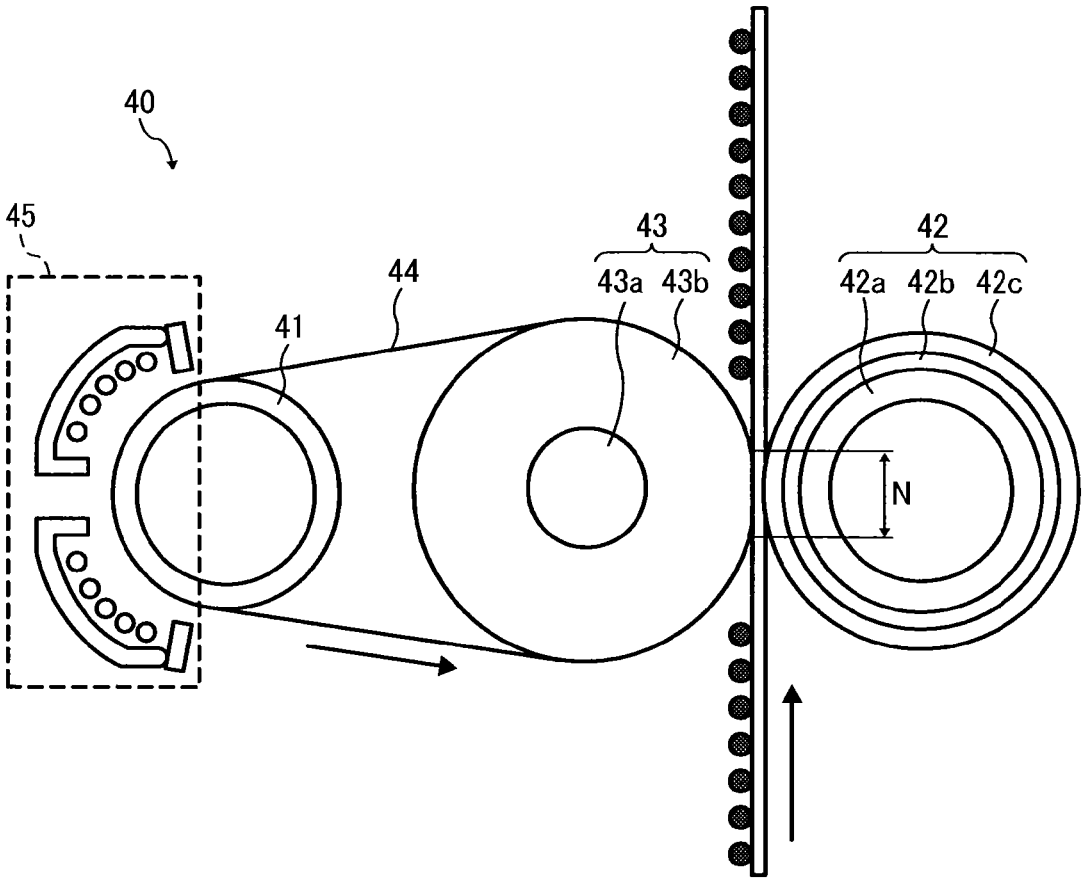
FIG. 2 is a schematic sectional view of a fixing device according to a first embodiment incorporated in the image forming apparatus of FIG. 1.

Referring now to FIG. 2, a description is given of a fixing device 40 according to a first embodiment.

FIG. 2 is a schematic sectional view of the fixing device 40 according to the first embodiment incorporated in the image forming apparatus 100 described above.

The fixing device 40 includes, e.g., a heating roller 41, a fixing roller 43, a fixing belt 44 stretched over the heating roller 41 and the fixing roller 43, an induction heater 45 facing the heating roller 41 via the fixing belt 44, and a pressing roller 42 configured to contact the fixing roller 43 via the fixing belt 44, that is, to contact the outer surface of the fixing belt 44, opposite the fixing roller 43, with the fixing belt 44 sandwiched therebetween.

The heating roller 41 serving as a heat generator is a stainless steel roller having a thickness of about 0.2 mm to about 1 mm. The heating roller 41 may be covered by a copper (CU) layer having a thickness of about 3 μm to about 20 μm to enhance the efficiency of heat generation. In such a case, preferably, the copper (Cu) layer may be nickel-plated to prevent rust. A ferrite core may be disposed inside the heating roller 41 to enhance the efficiency of heat generation.

Alternatively, the heating roller 41 may be made of a magnetic shunt alloy having a Curie point of about 160° C. to about 220° C. An aluminum member may be disposed inside the magnetic shunt alloy to stop a temperature rise around the Curie point. The heating roller 41 made of the magnetic shunt alloy may be covered by a nickel-plated copper (Cu) layer to enhance the efficiency of heat generation.

The fixing roller 43 is constructed of a metal core 43*a* and an elastic member 43*b*. The metal core 43*a* is, e.g., stainless steel or carbon steel. The elastic member 42*b* is, e.g., solid or foam heat-resistant silicone rubber, and coats the metal core 43*a*. The fixing roller 43 and the pressing roller 42 contact each other with pressure applied by the pressing roller 42, thereby forming an area of contact herein called a fixing nip N having a predetermined width. The fixing roller 43 has an outer diameter of about 30 mm to about 40 mm. The elastic member 43*b* has a thickness of about 3 mm to about 10 mm and a JIS-A hardness of about 10° to about 50°.

Figure 3:
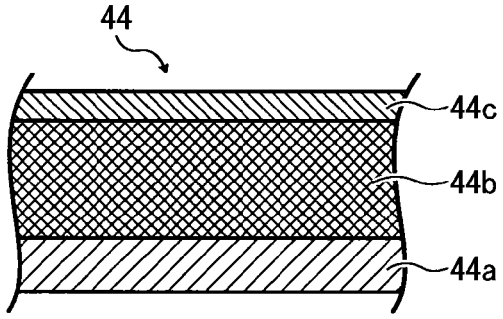
FIG. 3 is a partial sectional view of a fixing belt incorporated in the fixing device of FIG. 2.

Referring now to FIG. 3, a detailed description is given of the fixing belt 44 serving as a fixing member.

FIG. 3 is a partial sectional view of the fixing belt 44 incorporated in the fixing device 40 described above.

The fixing belt 44 is constructed of a substrate 44*a*, an elastic layer 44*b* and a release layer 44*c*. As illustrated in FIG. 3, the elastic layer 44*b* rests on the substrate 44*a*, and the release layer 44*c* rests on the elastic layer 44*b*. The substrate 44*a* has mechanical strength and flexibility when the fixing belt 44 is stretched, and heat resistance at a fixing temperature. According to the first embodiment, the heating roller 41 is inductively heated. Hence, the substrate 44*a* is preferably made of an insulating heat-resistant resin material such as polyimide, polyimide-amide, polyether-ether ketone (PEEK), polyether sulfide (PES), polyphenylene sulfide (PPS), or fluorine resin. The substrate 44*a* preferably has a thickness of about 30 μm to about 200 μm for heat capacity and strength. The elastic layer 44*b* is employed to give flexibility to a surface of the fixing belt 44 to obtain a uniform image without uneven glossiness. Hence, the elastic layer 44*b* preferably has a JIS-A hardness of about 5° to about 50° and a thickness of about 50 μm to about 500 μm. In addition, the elastic layer 44*b* is made of a material of, e.g., silicone rubber or fluorosilicone rubber for heat resistance at a fixing temperature. The release layer 44*c* is made of a material of, e.g., fluorine resin such as tetrafluoride ethylene resin (PTFE), tetrafluoride ethylene-perfluoroalkyl vinylether copolymer resin (PFA) or tetrafluoride ethylene-hexafluoride propylene copolymer (FEP), combinations of the foregoing resin materials, or heat-resistant resin in which the foregoing fluorine resin is dispersed.

By coating the elastic layer 44*b* with the release layer 44*c*, toner releasability can be enhanced without using silicone oil, thereby preventing paper dust from sticking to the fixing belt 44 and realizing an oil-less system. However, the resin having good releasability does not typically have elasticity like that of a rubber material. Accordingly, if a thick release layer 44*c* is formed on the elastic layer 44*b*, the flexibility of the surface of the fixing belt 44 might be lost to an extent, causing uneven glossiness. To strike a good balance between flexibility and releasability, the release layer 44*c* has a thickness of about 5 μm to about 50 μm, and preferably about 10 μm to about 30 μm.

Optionally, a primer layer may be provided between the foregoing layers. A durable layer may be provided on an inner surface of the substrate 44*a* to enhance sliding durability against the heating roller 41 and the fixing roller 43. Preferably, a heat generation layer may be formed on the substrate 44*a*. For example, a copper (Cu) layer having a thickness of about 3 μm to about 15 μm may be formed on a base layer of, e.g., polyimide to be used as a heat generation layer.

Returning to FIG. 2, the pressing roller 42 is constructed of a cylindrical metal core 42*a*, a high heat-resistant elastic layer 42*b*, and a release layer 42*c*. The pressing roller 42 presses the fixing roller 43 via the fixing belt 44 to form the fixing nip N therebetween. The pressing roller 42 has an outer diameter of about 30 mm to about 40 mm. The elastic layer 42*b* has a thickness of about 0.3 mm to about 5 mm and an Asker hardness of about 20° to about 50°. The elastic layer 42*b* is made of a heat-resistant material such as silicone rubber. In addition, the release layer 42*c* made of fluorine resin having a thickness of about 10 μm to about 100 μm is formed on the elastic layer 42*b* to enhance releasability upon two-sided printing operation.

The pressing roller 42 is configured to be harder than the fixing roller 43 so that the pressing roller 42 presses and is engaged with the fixing roller 43 via the fixing belt 44. Such an engagement gives a curvature to the sheet P sufficient to prevent the sheet P from hugging the surface of the fixing belt 44 when the sheet P exits the fixing nip N. Thus, the releasability of the sheet P can be enhanced.

Figure 4B:
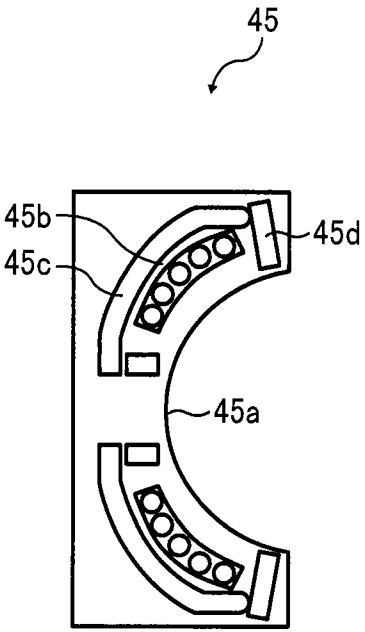
FIG. 4B is a cross-sectional view of the induction heater of FIG. 4A.
Figure 4A:
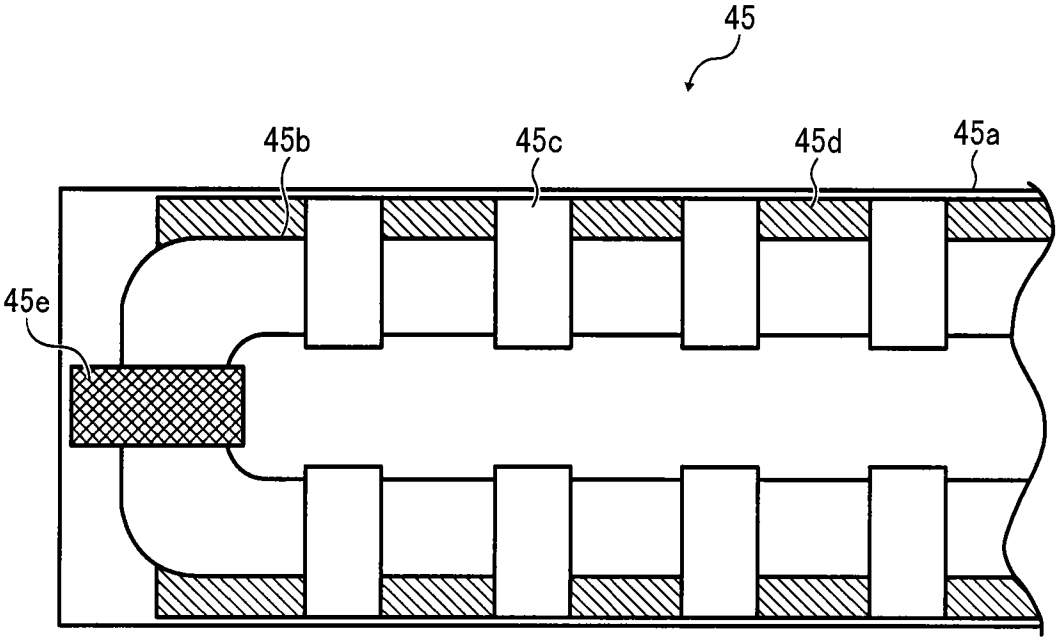
FIG. 4A is a partial top view of an induction heater incorporated in the fixing device of FIG. 2.

Referring now to FIGS. 4A and 4B, a detailed description is given of the induction heater 45 to heat the heating roller 41 by electromagnetic induction.

FIG. 4A is a partial top view of the induction heater 45 incorporated in the fixing device 40 described above. FIG. 4B is a cross-sectional view of the induction heater 45.

The induction heater 45 includes a case 45*a* serving as a coil holder, an excitation coil 45*b* wound in a longitudinal direction of the induction heater 45, and ferromagnetic cores. The ferromagnetic cores include arch cores 45*c*, side cores 45*d* and end cores 45*e*. The ferromagnetic cores, namely, the arch cores 45*c*, the side cores 45*d* and the end cores 45*e*, are disposed to encompass the excitation coil 45*b*, thereby forming a magnetic path to direct magnetic flux arising from the excitation coil 45*b* to the heating roller 41.

The excitation coil 45*b* is prepared by 5-20 windings of a Litz wire. The Litz wire is constructed of about 50 to about 500 conductive wire strands, individually insulated and twisted together. Each conductive wire strand has a diameter of about 0.05 mm to about 0.2 mm. A fusion layer is provided on a surface of the Litz wire. The fusion layer is stiffened by applying heat either by means of supplying power or in a thermostatic oven. Accordingly, a winding shape of the excitation coil 45*b* can be maintained. Alternatively, the excitation coil 45*b* may be prepared by winding a Litz wire without a fusion layer, and press-molding the wound Litz wire to reliably maintain the shape of the excitation coil 45*b*. To provide the Litz wire with heat resistance at a fixing temperature or higher, resin having insulation performance and heat resistance, such as polyamide-imide or polyimide, may be used as an insulation material to coat the Litz wire.

The windings of the excitation coil 45*b* are glued to the case 45*a* with an adhesive, e.g., silicone glue. The case 45*a* is disposed to cover part of an outer circumferential surface of the heating roller 41 with a slight gap therebetween. To ensure heat resistance at a fixing temperature or higher, the case 45*a* is made of a high heat-resistant resin material such as polyethylene terephthalate (PET) or liquid crystal polymers.

Each of the ferromagnetic cores, namely, the arch cores 45*c*, the side cores 45*d* and the end cores 45*e*, is made of a ferrite material such as a manganese-zinc (Mn—Zn) ferrite material or a nickel-zinc (Ni—Zn) ferrite material. A plurality of side cores 45*d* are arranged in a rotational axis direction of the heating roller 41 to minimize warping of the side cores 45*d* during a sintering process that contracts the ferrite material. The end cores 45*e* are disposed at each end of the excitation coil 45*b* to increase the temperature of each end, thereby preventing the temperature of each end of the sheet P from decreasing in the fixing nip N. If the temperature is sufficiently uniform in the fixing nip N, the end cores 45*e* may be omitted.

Figure 5A:
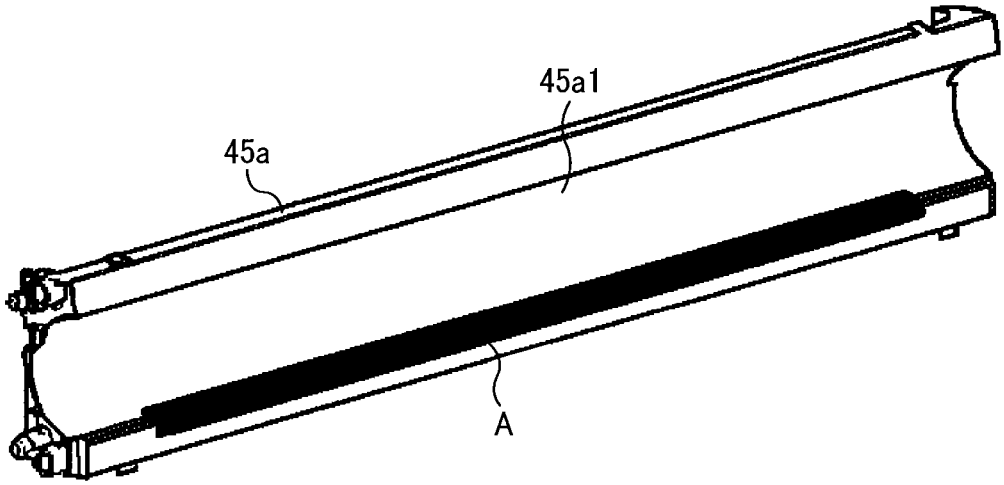
FIG. 5A is a perspective view of a case as a first example incorporated in the induction heater of FIGS. 4A and 4B.
Figure 5B:
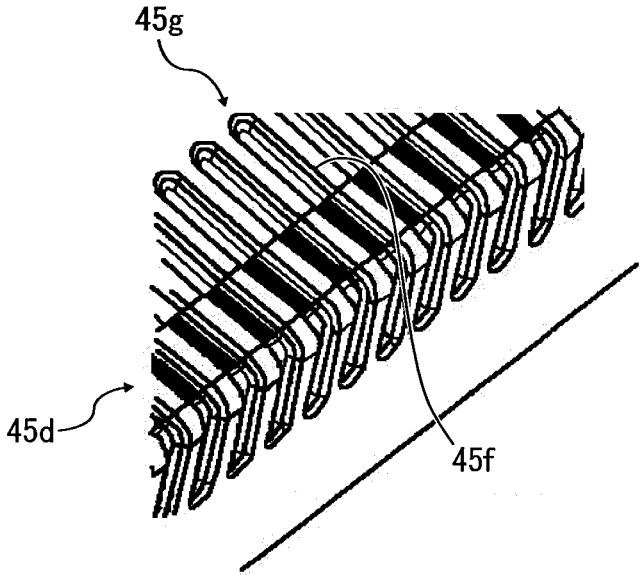
FIG. 5B is a partially enlarged view of the case of FIG. 5A, illustrating slits as a first example.

Referring now to FIGS. 5A and 5B, a detailed description is given of the case 45*a*.

FIG. 5A is a perspective view of the case 45*a* as a first example incorporated in the induction heater 45 described above, particularly illustrating a surface 45*a*1 that faces the heating roller 41 serving as a heat generator. FIG. 5B is an enlarged view of a portion A of the case 45*a* illustrated in FIG. 5A.

According to the embodiments of this disclosure, a ferromagnetic core is formed as an integral part of a case, which serves as a holder or coil guide, and exposed at slits formed in a surface of the case facing a heat generator. For example, as illustrated in FIGS. 5A and 5B, slits 45*f* as a first example are formed, across the width of the largest sheet P capable of passing through the fixing nip N, in the surface 45*a*1 of the case 45*a* incorporated in the induction heater 45 facing the heating roller 41. Specifically, the slits 45*f* extend parallel to a direction perpendicular to the longitudinal direction of the induction heater 45, that is, a circumferential direction of the surface 45*a*1. The slits 45*f* are formed in a bottom area of the surface 45*a*1, that is, an area located on a downstream side in a direction of rotation of the fixing belt 44 or an entry side from which the sheet P enters the fixing nip N. It is to be noted that the circumferential direction of the surface 45*a*1 corresponds to the direction of rotation of the fixing belt 44.

The side core 45*d* is coupled to the portion A in which the slits 45*f* are formed so as to partially cover a bottom side of each of the slits 45*f*. Each of the slits 45*f* has a partial bottom, with an open bottom portion covered by the side core 45*d*. Thus, the side core 45*d* and the slits 45*f* together define bottomed grooves 45*g*. Taking into account the formability of resin used for the case 45*a*, each of the bottomed grooves 45*g* preferably has a depth of about 0.2 mm to about 3 mm, and a width of about 0.5 mm to about 5 mm. In addition, the bottomed grooves 45*g* are preferably disposed at intervals of about 0.5 mm to about 5 mm. The side core 45*d* thus coupled to the slits 45*f* to cover the open bottom portion of the slits 45*f* is exposed at the slits 45*f*. The side core 45*d* made of a ferrite material has a higher heat conductivity and a larger heat capacity than a resin material. Accordingly, if wax adheres to the surface 45*a*1 of the case 45*a*, the wax adheres to the side core 45*d* through the slits 45*f*. Accordingly, the temperature of the wax hardly increases when the wax is heated by the heating roller 41 serving as a heat generator, and therefore, the wax is hardly fused again.

Referring now to Table 1, a description is given of a comparison of the heat conductivity of some specific materials. As is apparent from Table 1, ferrite material has about ten times the heat conductivity and about twice the heat capacity of liquid crystal polymers. The ferrite material thus having a relatively high heat conductivity can quickly absorb heat that is received by the wax. In addition, the ferrite material thus having a larger heat capacity can absorb a larger amount of heat than the liquid crystal polymers. With such a high heat conductivity and a heat capacity, a relatively large amount of heat from the wax is quickly absorbed by the side core 45*d*, thereby preventing a temperature rise and re-fusion of the wax, and thus further preventing the wax from adhering to the sheet P during fixing of an image formed on the sheet P.

TABLE 1

| | Material | | | | | | |
|---|---|---|---|---|---|---|---|
| | Ferrite core | | | Liquid Crystal Polymer | | | |
| | Manufacturer | | | | | | |
| | TDK Corporation | | | Polyplastics Co., Ltd. | | | |
| | Ingredient | | | | | | |
| | PE22 | PC40 | PE90 | E130i | E473i | E481i | T135B |
| Heat Conductivity W/m · K | 5 | 5 | 5 | 0.54 | 0.6 | 0.73 | 0.55 |
| Heat Capacity MJ/m3 · K | 2.88 | 2.88 | 2.94 | 1.66 | 1.6 | 1.66 | 1.63 |

Figure 6:
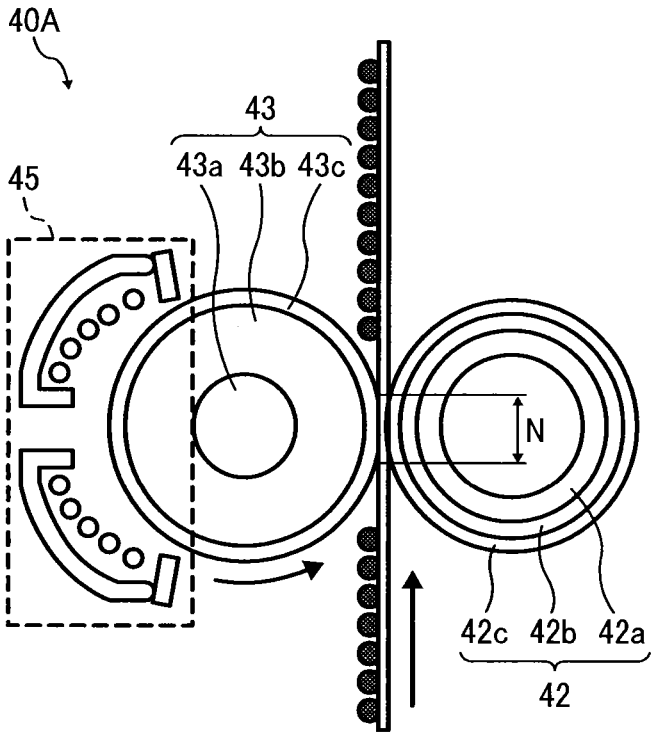
FIG. 6 is a schematic sectional view of a fixing device according to a second embodiment.

Alternatively, the induction heater 45 installed in the fixing device 40 of FIG. 2, employing a belt-type fixing method, may be installed in a fixing device employing a roller-type fixing method, such as a fixing device 40A according to a second embodiment illustrated in FIG. 6.

FIG. 6 is a schematic sectional view of the fixing device 40A according to the second embodiment. As described above, the fixing device 40A is a fixing device employing the roller-type fixing method. The fixing devices employing the roller-type fixing method has a well-known configuration. Hence, a detailed description of the configuration of the fixing device 40A is herein omitted.

It is to be noted that, in the fixing device 40A according to the second embodiment, a fixing roller 43 having a heat generation layer 43*c* is inductively heated by an induction heater 45, instead of the heating roller 41 that is inductively heated by the induction heater 45 incorporated in the fixing device 40 according to the first embodiment. In other words, the fixing roller 43 serves as a fixing member and a heat generator. The heat generation layer 43*c* is constructed of, e.g., a base layer, a main heat generation layer, an elastic layer, and a release layer resting in this order from an inner circumference side of the heat generation layer 43*c*. The base layer of the heat generation layer 43*c* is made of nickel and has a thickness of about 3 μm to about 15 μm. The main heat generation layer is made of copper and has a thickness not greater than 5 μm. The elastic layer is made of silicone rubber and has a thickness of about 100 μm to about 500 μm. The release layer is made of a fluorine compound such as PFA and has a thickness of about 10 μm to about 100 μm. In the fixing device 40A according to the second embodiment, a distance between the induction heater 45 and a fixing nip N is shorter than a distance between the induction heater 45 and the fixing nip N in the fixing device 40 according to the first embodiment. Hence, wax is more likely to adhere to a ferromagnetic core and therefore fixing failures are more likely occur. Accordingly, the fixing device 40A according to the second embodiment has a greater advantage of adapting the induction heater 45 that incorporates the case 45*a* in which the side core 45*d* is exposed at the slits 45*f* to prevent such fixing failures.

Figure 7:
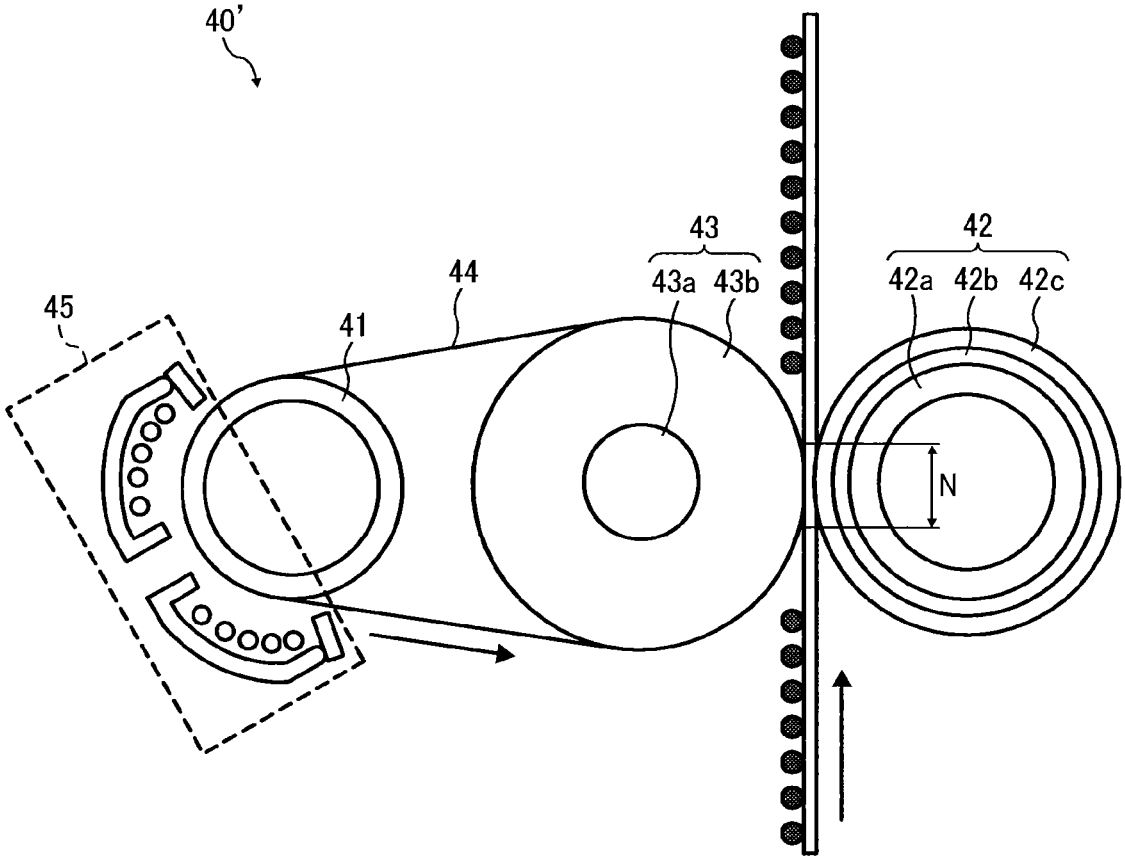
FIG. 7 is a schematic sectional view of a fixing device according to a third embodiment.
Figure 8:
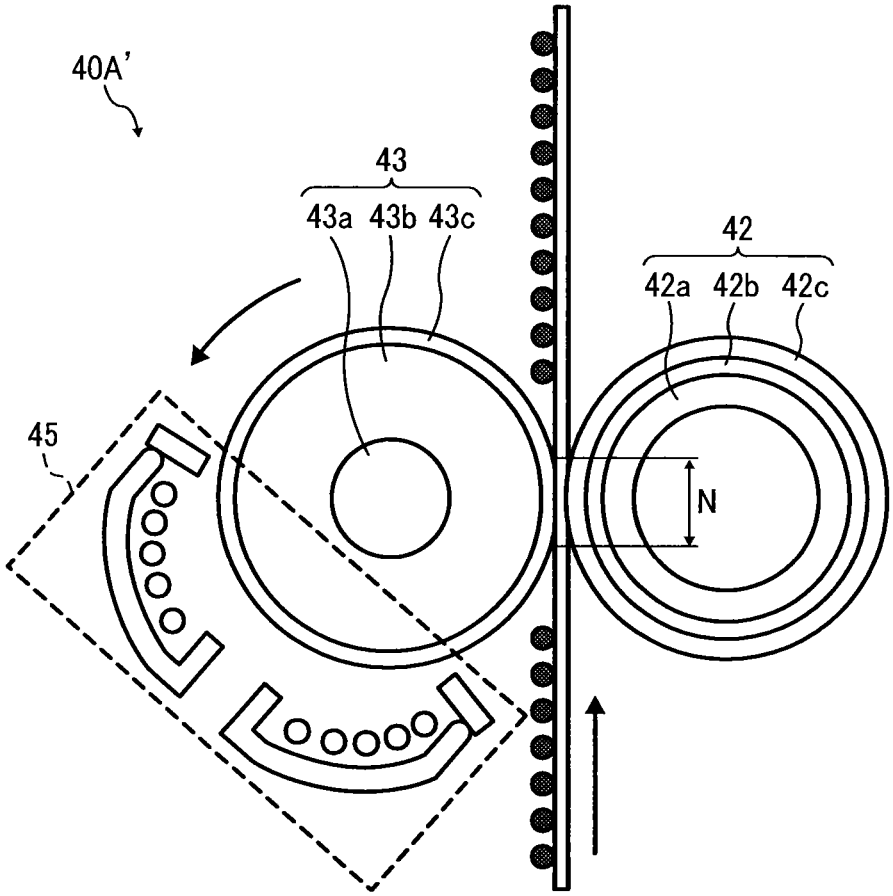
FIG. 8 is a schematic sectional view of a fixing device according to a fourth embodiment.

Instead of the foregoing arrangements illustrated in FIGS. 2 and 6, alternatively, the induction heater 45 may be disposed as illustrated in FIG. 7 or in FIG. 8.

Referring now to FIGS. 7 and 8, descriptions are given of fixing devices 40' and 40A' according to third and fourth embodiments, respectively.

FIG. 7 is a schematic sectional view of the fixing device 40' according to the third embodiment. FIG. 8 is a schematic sectional view of the fixing device 40A' according to the fourth embodiment.

In each of the fixing devices 40' and 40A' according to the third and fourth embodiments, respectively, a case 45*a* of an induction heater 45 is inclined such that a surface 45*a*1 of the case 45*a* is closer to an entry side from which a sheet P enters a fixing nip N. The sheet P is conveyed upward, and the induction heater 45 faces upward. The induction heater 45 serving as a heat source thus disposed closer to the fixing nip N can enhance heat efficiency. Specifically, in the fixing device 40' according to the third embodiment, heat release can be reduced while a portion of a fixing belt 44 that is heated by the induction heater 45 via a heating roller 41 reaches the fixing nip N, thereby enhancing heat efficiency. In the fixing device 40A' according to the fourth embodiment, heat release can be reduced while a portion of fixing roller 43 that is heated by the induction heater 45 reaches the fixing nip N, thereby enhancing heat efficiency. It is to be noted that the fixing device 40' according to the third embodiment has the same configuration as the fixing device 40 according to the first embodiment, differing only in the arrangement of the induction heater 45. The fixing device 40A' according to the fourth embodiment has the same configuration as the fixing device 40A according to the second embodiment, differing only in the arrangement of the induction heater 45. Hence, detailed descriptions of the configurations of the fixing devices 40' and 40A' according to the third and fourth embodiments, respectively, are herein omitted.

In such arrangement of the induction heater 45 as illustrated in FIGS. 7 and 8, bottomed grooves 45*g* face upward because the bottomed grooves 45*g* are located on an upstream side of the fixing nip N in a direction of conveyance of the sheet P, in which the sheet P is conveyed upward. In an alternative fixing device in which a sheet P is conveyed horizontally, bottomed grooves 45*g* may face upward as in the fixing devices 40, 40A, 40' and 40A' according to the foregoing embodiments. In any arrangement of the induction heater 45 illustrated in FIGS. 2, 6, 7, and 8, the side core 45*d* made of a ferrite material is exposed at the slits 45*f*. Accordingly, if wax adheres to the side core 45*d*, the wax is hardly fused.

Figure 9A:
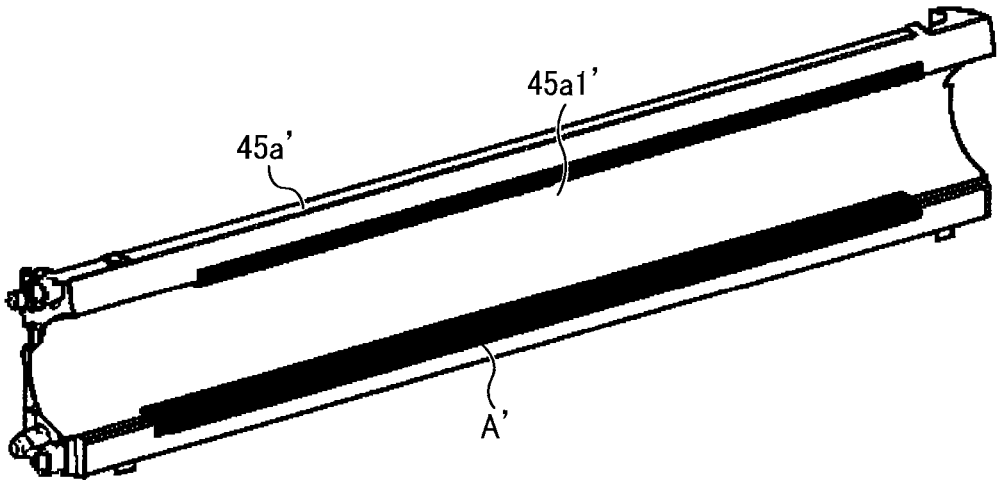
FIG. 9A is perspective view of a case as a second example.

Referring now to FIG. 9A, a description is given of a case 45*a*' as a second example.

FIG. 9A is a perspective view of the case 45*a*' as a second example, particularly illustrating a surface 45*a*1' that faces a heat generator (e.g., heating roller 41).

In the foregoing embodiments, the slits 45*f* are formed in the bottom area of the surface 45*a*1, that is, the area located on the downstream side in the direction of rotation of a fixing member (e.g., fixing belt 44). In addition to the bottom area, the case 45*a*' has slits 45*f* in a top area, that is, an area located on an upstream side in the direction of rotation of the fixing member. In other words, the slits 45*f* are formed in areas located on the entry side from which the sheet P enters the fixing nip N and on an exit side toward which the sheet P exits the fixing nip N. The slits 45*f* and accordingly bottomed grooves 45*g* are symmetrically arranged in a cross-section of the case 45*a'*, thereby reducing warping in a longitudinal direction of the induction heater 45 upon molding. Accordingly, a uniform gap is created between the induction heater 45 and a heat generator (e.g., heating roller 41) in the longitudinal direction, thereby uniformly preventing wax from adhering to the sheet P in the longitudinal direction during fixing of an image formed on the sheet P.

As described above, each of the slits 45*f* formed in the surface 45*a*1 has a partial bottom, with an open bottom portion covered by the side core 45*d*, thereby defining the bottomed grooves 45*g*. The partial bottom is thin and might have a hole due to filling failures upon molding. To prevent creation of such a hole, slits 45*f'* are formed as illustrated in FIG. 9B as a second example.

Figure 9B:
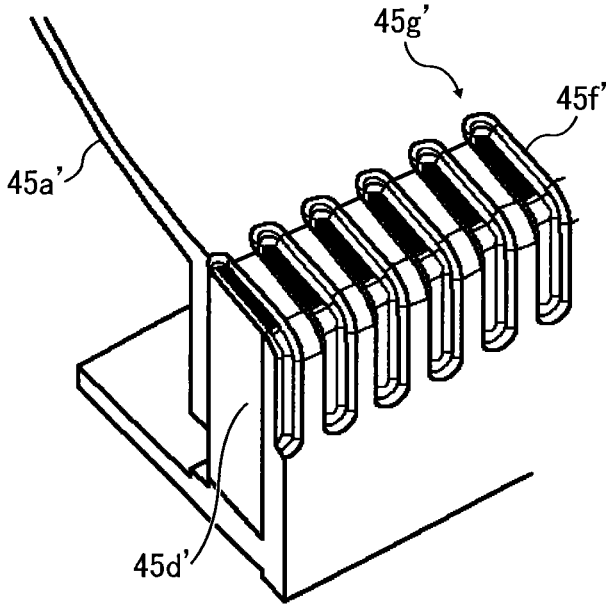
FIG. 9B is a partially enlarged view of the case of FIG. 9A, illustrating slits as a second example.

FIG. 9B is an enlarged view of a portion A' of the case 45*a*' illustrated in FIG. 9A. Each of the slits 45*f'* is formed not longer than a length of a side core 45*d'* in the circumferential direction of the surface 45*a*1' (i.e., direction of rotation of a fixing member). The side core 45*d'* is coupled to the slits 45*f'* to cover an open bottom portion of each of the slits 45*f'*. Thus, the side core 45*d'* and slits 45*f'* together define bottomed grooves 45*g'*. Accordingly, the side core 45*d'* serves to reinforce the slits 45*f'* if the slits 45*f'* are relatively narrow.

Although the slits 45*f'* are herein illustrated such that the slits 45*f'* are formed in the top and bottom areas of the surface 45*a*1' in the case 45*a'* illustrated in FIG. 9A, the slits 45*f'* may be formed in the case 45*a* illustrated in FIG. 5B such that the slits 45*f'* are formed only in the bottom area of the surface 45*a*1.

As described above, slits (e.g., 45*f'*) are formed in a surface (e.g., surface 45*a*1') facing a heat generator (e.g., heating roller 41) of a holder (e.g., case 45*a'*). The slits extend in a direction of rotation of a fixing member (fixing belt 44). The slits and a ferromagnetic core (e.g., side core 45*d'*) that is formed as an integral part of the holder define bottomed grooves. Thus, the ferromagnetic core is exposed at the slits as seen from the heat generator. In such a configuration, if wax is evaporated from toner and adheres to the bottomed grooves, the wax contact the ferromagnetic core having a larger heat capacity than the holder. Accordingly, the wax is hardly fused again, thereby preventing the wax from adhering to a recording medium (e.g., sheet P) during fixing operation, regardless of how an induction heater (e.g., induction heater 45) is oriented.

This disclosure has been described above with reference to specific exemplary embodiments. It is to be noted that this disclosure is not limited to the details of the embodiments described above, but various modifications and enhancements are possible without departing from the scope of the invention. It is therefore to be understood that this disclosure may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. A fixing device comprising:

a fixing member including a heat generator; and an induction heater to heat the fixing member by electromagnetic induction, the induction heater including:

an excitation coil;

a ferromagnetic core to form a magnetic path to direct magnetic flux arising from the excitation coil to the fixing member; and a holder to hold the excitation coil and the ferromagnetic core, the holder having a surface facing the heat generator, the surface having a plurality of slits extending parallel to a direction of rotation of the fixing member, the ferromagnetic core coupled to the holder and covering an open bottom portion of each slit of the plurality of slits to form a plurality of bottomed grooves.

2. The fixing device according to claim 1, wherein the plurality of bottomed grooves are formed in the surface of the holder facing the heat generator on both upstream and downstream sides of the fixing member in the direction of rotation of the fixing member.

3. The fixing device according to claim 1, wherein the induction heater is inclined such that the surface having the plurality of slits faces upward toward the heat generator.

4. The fixing device according to claim 1, wherein each slit of the plurality of slits has a length not greater than a length of the ferromagnetic core in the direction of rotation of the fixing member.

5. An image forming apparatus comprising the fixing device according to claim 1.

* * * * *